US010213891B2

(12) United States Patent
Palushaj

(10) Patent No.: US 10,213,891 B2
(45) Date of Patent: Feb. 26, 2019

(54) WOOD DECK SANDING TOOL

(71) Applicant: Diamabrush LLC, Madison Heights, MI (US)

(72) Inventor: Simon Palushaj, Washington, MI (US)

(73) Assignee: Diamabrush LLC, Madison Heights, MI (US)

( * ) Notice: Subject to any disclaimer, the term of this patent is extended or adjusted under 35 U.S.C. 154(b) by 182 days.

(21) Appl. No.: 15/190,988

(22) Filed: Jun. 23, 2016

(65) Prior Publication Data

US 2017/0368658 A1 Dec. 28, 2017

(51) Int. Cl.

| | |
|---|---|
| ***B24B 7/18*** | (2006.01) |
| ***B24D 13/14*** | (2006.01) |
| ***B24D 13/16*** | (2006.01) |
| ***B24B 19/24*** | (2006.01) |
| ***B24B 23/02*** | (2006.01) |
| ***B24D 7/06*** | (2006.01) |
| ***B24B 7/28*** | (2006.01) |

(52) U.S. Cl.

CPC ..... *B24B 7/186* (2013.01); *B24B 7/28* (2013.01); *B24B 19/24* (2013.01); *B24B 23/028* (2013.01); *B24D 7/066* (2013.01); *B24D 13/14* (2013.01); *B24D 13/16* (2013.01)

(58) Field of Classification Search

None

See application file for complete search history.

(56) References Cited

U.S. PATENT DOCUMENTS

| | | | |
|---|---|---|---|
| D548,757 | S | 8/2007 | Ruan |
| D589,541 | S | 3/2009 | Park |
| D590,850 | S | 4/2009 | Park |
| D595,320 | S | 6/2009 | Park |
| D595,749 | S | 7/2009 | Kusuyama |
| D626,977 | S | 11/2010 | Popov |
| D660,888 | S | 5/2012 | Piliguian |

(Continued)

FOREIGN PATENT DOCUMENTS

| | | | |
|---|---|---|---|
| WO | 2008/0889081 | A1 | 7/2008 |
| WO | 2008/142544 | A1 | 11/2008 |
| WO | 2014/086367 | A1 | 6/2014 |

OTHER PUBLICATIONS

Non-Final Office Action dated Sep. 18, 2017 for U.S. Appl. No. 29/570,958 (27 pages).

(Continued)

*Primary Examiner* — Joseph J Hail

*Assistant Examiner* — Brian D Keller

(74) *Attorney, Agent, or Firm* — Bejin Bieneman PLC

(57) ABSTRACT

A sanding wheel that may be used, e.g., to finish a wood deck, includes one or more risers. Each riser includes an angled face and a cross member, and the angled face and cross member define a slot therebetween. The retaining or fastening clip includes a retaining spring, and the fastening clip is received on the angled face of the riser with the retaining spring extending into the slot. The blade has an abrasive on a first end and an aperture at a second end, the aperture being defined by a shoulder about the aperture. The second end of the blade extends into the slot with the retaining spring of the fastening clip engaging the shoulder. The slot and the retaining spring are configured to mechanically lock the blade to the riser and the base.

10 Claims, 3 Drawing Sheets

(56) References Cited

U.S. PATENT DOCUMENTS

| | | | | |
|---|---|---|---|---|
| D681,078 | S | 4/2013 | Heo | |
| D682,651 | S | 5/2013 | McRoberts | |
| D797,168 | S | 9/2017 | Ruan | |
| 2008/0176494 | A1* | 7/2008 | Palushaj | B24B 7/186<br>451/353 |
| 2008/0176498 | A1* | 7/2008 | Rossi | B24B 7/186<br>451/508 |

OTHER PUBLICATIONS

International Search Report and Written Opinion of the ISA for PCT/US2017/037412 dated Sep. 20, 2017 (12 pages).

* cited by examiner

FIG. 3
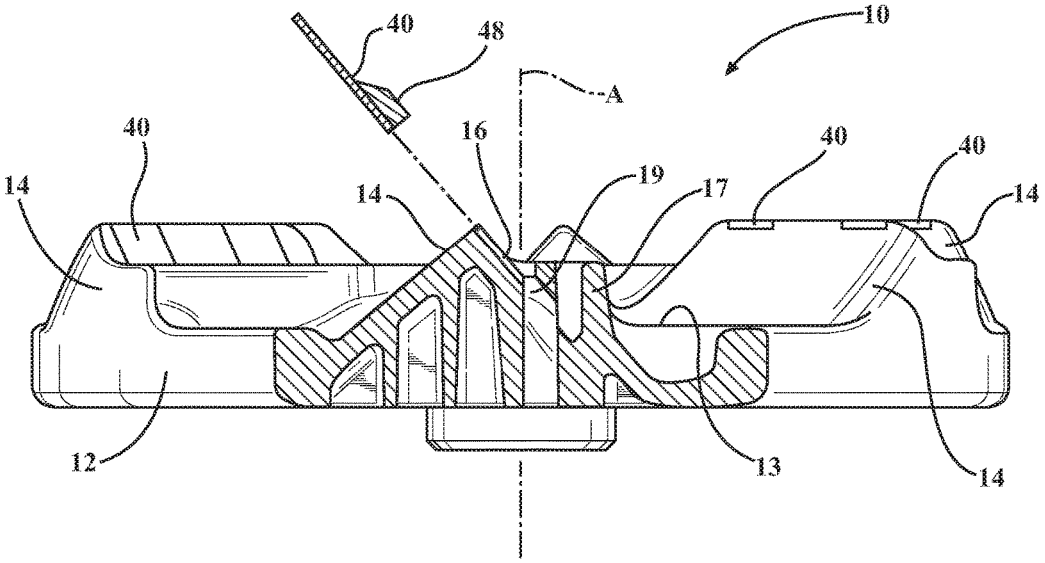
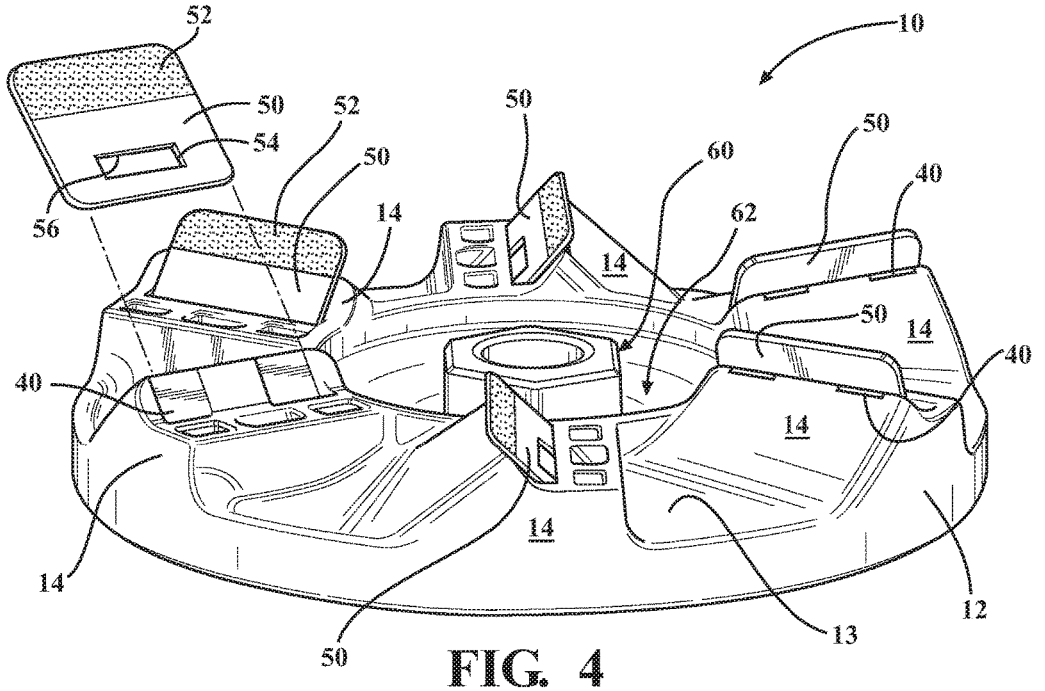
FIG. 4

WOOD DECK SANDING TOOL

BACKGROUND

The present disclosure generally relates to sanding wheels and more particularly relates to a sanding wheel that includes replaceable blades.

Sanding wheels are used for a variety of sanding and finishing applications. Non-limiting examples of these applications include sanding and finishing wood decks, removing mastic from floors, sanding tile floors, sanding walls and the like. A variety of sanding tools are available in the market.

Sanding wheels that are used with hand tools have been improved by Applicant. For example, Applicant promotes a sanding tool under U.S. Pat. No. 8,043,144. Such sanding tools have proven to be very successful in the market.

A need has arisen for an improved sanding wheel.

SUMMARY

A sanding wheel is provided herein, the sanding wheel including a base having at least one riser, the riser including an angled face, the angled face being coplanar with a slot. A fastening clip is received on the angled face of the riser. The fastening clip includes a retaining spring that captures a blade having an abrasive on a first end. The blade has an aperture at a second end and a shoulder positioned adjacent the aperture, where the retaining spring is sized to be received in the aperture so that the blade is fastened to the sanding wheel.

The sanding wheel may include a plurality of concentric risers and the riser may include a pair of slots and a boss. In a first preferred embodiment, the base may be made with plastic and the blade may be made from metal.

A sanding blade is also provided where the sanding blade is configured for attachment to a sanding wheel where the sanding wheel includes a retaining spring associated therewith. The blade includes a sanding section having a hard abrasive particle affixed thereto; and a retaining shoulder adjacent to an aperture in the sanding blade the retaining shoulder sized to mate with the retaining spring.

BRIEF DESCRIPTION OF THE DRAWINGS

FIG. 3 is a side cross sectional side view of the improved sanding wheel showing installation of the fastening clip.

FIG. 4 is a perspective view of the improved sanding wheel including a front face of a replaceable sanding blade.

DETAILED DESCRIPTION

Figure 1:
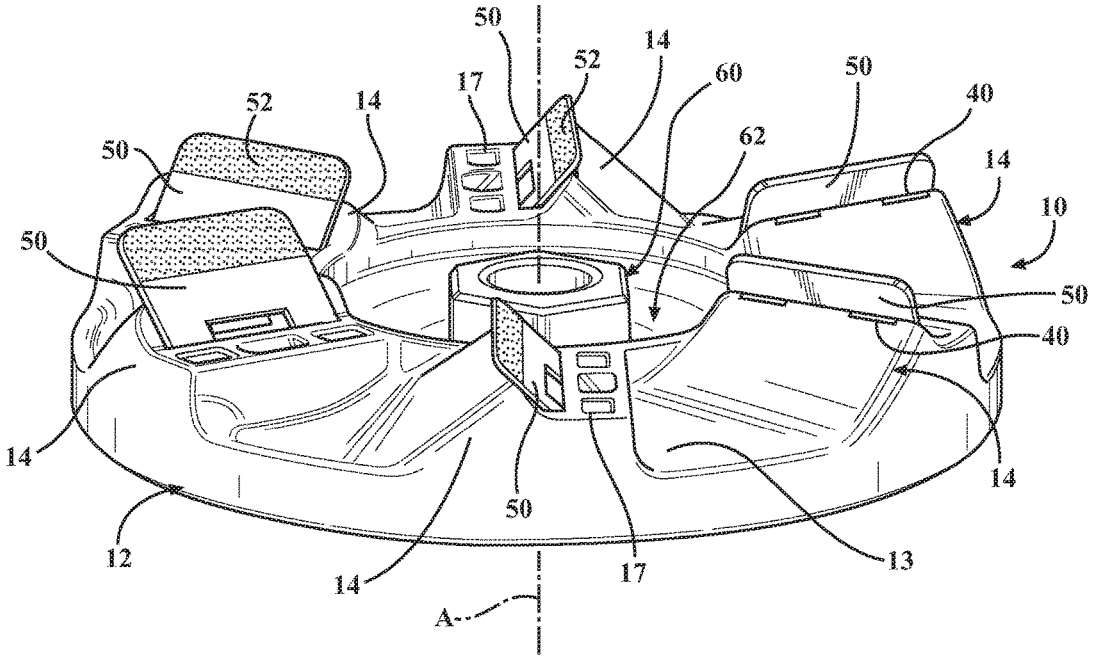
FIG. 1 is a perspective view of an improved sanding wheel with sanding blades in place.

The drawings show exemplary views an improved sanding wheel according to the principles of the present disclosure that, e.g., provides blades that snap into place without the need for separate fasteners and an expensive base. The sanding wheel includes a base having several risers that substantially axially protrude from a front face of the base and, in some embodiments, are arranged on the front face in a substantially circular shape about a center portion of the base. In some embodiments, the substantially circular arrangement of the risers may be concentric with a center axis of a fastener of the sanding wheel configured to engage a mount or output shaft of a hand tool.

These risers support a sanding blade as described herein. In some embodiments of a sanding wheel according to the principles of the present disclosure, e.g. wheels designed for use with smaller hand tools, there may be six risers. In other embodiments of a sanding wheel according to the principles of the present disclosure, e.g. wheels designed for use with larger tools, there may be more risers. It should be understood that the exemplary embodiments herein, illustrating a set of six risers arranged in a substantially circular shape, substantially equally angularly spaced within that substantially circular arrangement, the substantially circular arrangement being substantially concentric with the fastener 60, is exemplary. The configuration, total number of one or more risers, should not be understood to be limited to the exemplary embodiments of this disclosure. Rather, many variations of configuration of one or more risers on a sanding wheel should be understood to be within the scope of this disclosure.

Each riser includes an angled face, relative to the front face of the base, and an associated slot, defined in part by the angled face. A fastening clip is configured to be received on the angled face and in the slot and to be captured on, i.e. relatively coupled to, the angled face. The fastening clip includes a retaining spring operable to secure a sanding blade. The retaining spring is positioned below the opening of the slot. The sanding blade includes an aperture and shoulder where the retaining spring is received in the aperture and, in cooperation with slot, captured thereby. As described herein, the base includes a plastic material, and each of the fastening clip and blade include a metal material. An abrasive is bonded to the blade. According to the principles of the present disclosure, the abrasive may include diamond material. As such, it should be understood that, as used herein, "sanding" and other derivative terms refers to abrading, generally, i.e. being or operable as an abrasive, inclusive of any suitable abrasive materials, e.g. diamonds. The tool described herein may be particularly useful to sand wood decks or polish concrete.

With reference to the drawings where like elements are numbered alike, there is shown a sanding wheel 10. As shown, sanding wheel 10 includes a carrier base 12 with a generally circular front face 13. The sanding wheel 10 further includes one or more risers 14 extending from the base 12. As shown, in some embodiments, the sanding wheel 10 includes six risers 14 extending axially away from the front face 13 of the base 12, with the axial direction defined along an axis A of a fastener 60 of the wheel 10, described in further detail herein. The front face 13 may be substantially orthogonal to the axial direction.

With reference to FIG. 1, each riser 14 is configured to support a sanding blade 50. According to the principles of the present disclosure, each sanding blade 50 includes an abrasive section 52 configured to abrade a substrate. The carrier base 12, including the risers 14, may include one of several suitable plastic materials, including, by way of non-limiting example, high density polyethylene or polycarbonate plastic materials.

Figure 2:
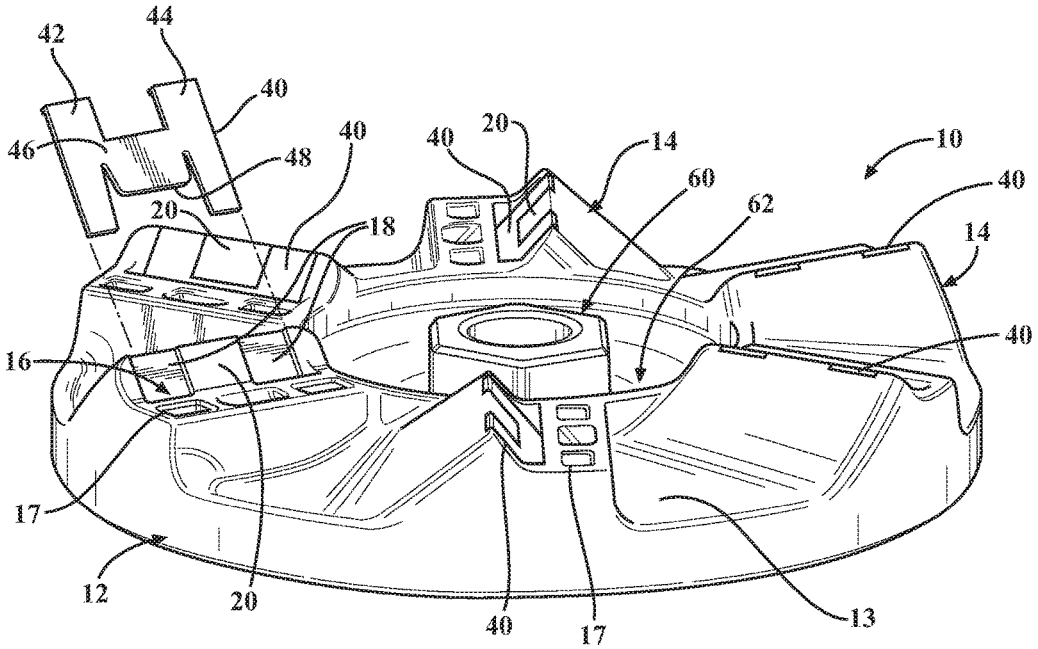
FIG. 2 is a perspective view of the improved sanding wheel showing installation of a fastening clip.
Figure 5:
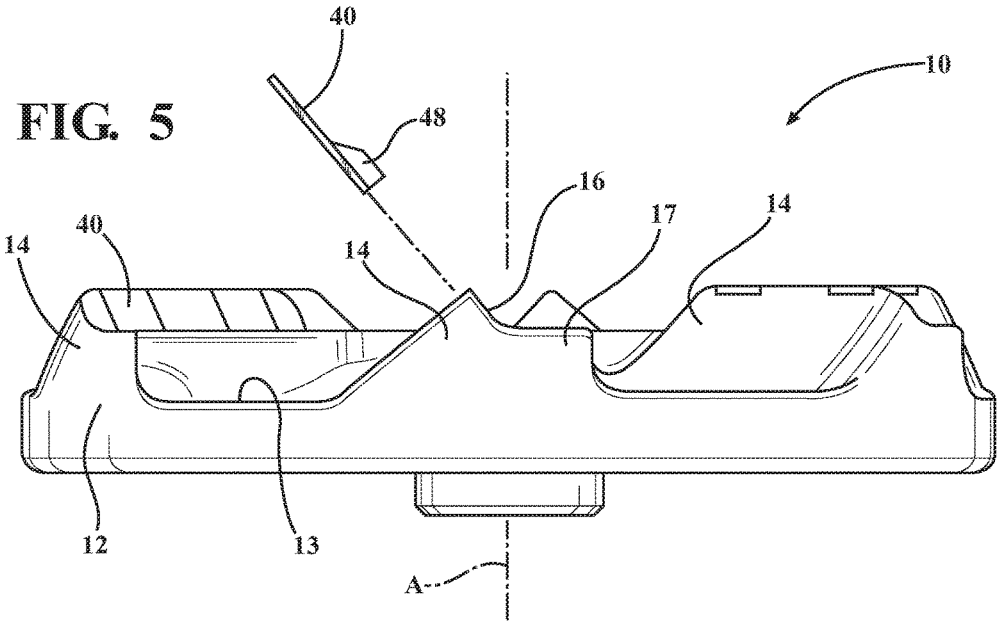
FIG. 5 is a side view of the improved sanding wheel showing installation of the fastening clip.
Figure 6:
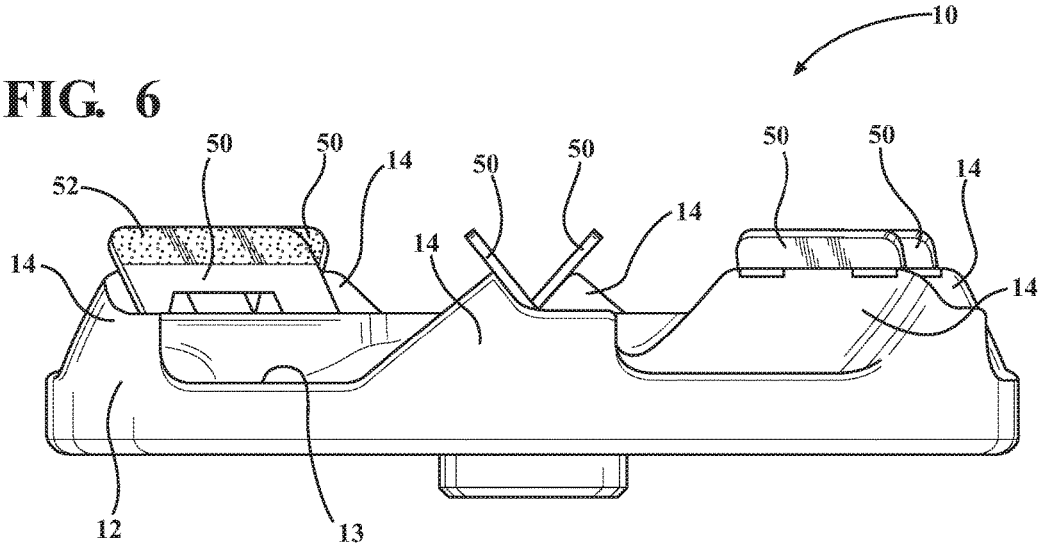
FIG. 6 is a side view of the improved sanding wheel including a replaceable sanding blade.

With reference to FIGS. 2 and 3, each riser 14 includes an angled face 16 configured to receive one of the sanding blades 50. In some embodiments, angled face 16 is oriented about 40 degrees from the axial direction, as defined along or parallel to the axis A of the fastener 60 of the wheel 10. Each such angled face 16 may, in some embodiments, be positioned at other angles, for example 35 degrees to 60 degrees from the axial direction. It should be understood that the orientation of the angled face 16 may also be identified relative to other components of the sanding wheel 10, e.g. the front face 13 of the base 12.

Each riser 14 further includes a cross member 17 axially between the outermost end of the angled face 16 and the front face 13. At each riser 14, therefore, each cross member 17 is outside of and radially overlaps the respective angled face 16 to create, with the respective angled face 16, a pocket or slot 19. In some embodiments, the pocket 19 is configured with a height between the angled face 16 and the cross member 17 corresponding to the total thickness of the fastening clip and the sanding blade. As shown in FIG. 3, angled face 16 of each riser 14 defines a pair of parallel channels 18 around a boss 20 protruding from the angled face 16. Parallel channels 18 extend into pocket 19.

With reference to FIG. 2, there is shown a fastening clip 40. Fastening clip 40 is adapted to attach to angled face 16. More particularly, the fastening clip 40 includes a pair of parallel legs 42 and 44. Legs 42 and 44 are connected by a cross portion 46. A retaining tab spring 48 extends from cross portion 46 and protrudes outside of the thickness of the fastening clip at the legs 42, 44 and the cross portion 46. Fastening clip 40 is received onto angled face 16 with the upper portions of legs 42 and 44 fitting into slots 18 and the retaining tab spring protruding from the angled face 16. Boss 20 is received between the upper portions of legs 42 and 44 such that the legs 42, 44 and the cross portion 46 of the fastening clip 40 are flush with the top surface of boss 20 and angled face 16. The fastening clip may, in some embodiments, include a metal material, such as spring steel and may be made, e.g., through a stamping process.

With reference to FIG. 4, there is shown a sanding blade 50 which is placed into slot 19 and configured to be captured by fastening clip 40. More particularly, blade 50 includes an abrasive section 52 positioned above an aperture 54. Abrasive particles are bonded onto blade 50 to form abrasive section. In one non-limiting example, abrasive particles are diamonds and are brazed onto blade 50. Abrasive particles may have a varying range in grit size, including, for example, a range from about 25 to about 170 grit. In another example, the grit may be 40/50 size. It should be appreciated that different grits are useful for different tasks. For example, lower grits provide improved stock removal while higher grits provide fine or finish sanding.

Aperture 54 is defined about its perimeter by a shoulder 56. The sanding blade 50 is received in pocket 19 and is captured on fastening clip 40 by fitting aperture 54 over cross member 46 and retaining spring 48 such that retaining tab spring 48 mechanically engages shoulder 56. The engagement of the sanding blade 50 by the pocket 19 and the retaining tab spring 48 mechanically locks the sanding blade 50 relative to the riser 14 and the base 12. Once each blade 50 is locked into place the manufacturing process of the tool is complete.

As shown in the exemplary embodiment herein fastening clip 40 does not extend beyond a top edge of riser 14. In alternate embodiments, fastening clip 40 may extend beyond the top edge of riser 14 to provide blade 50 additional support.

In other alternate embodiments, a retaining tab may be integrally formed in the angled face in the riser, and the fastening clip and boss may be omitted. In such an embodiment, the pocket between the angled face and the cross member may be configured with a height corresponding to the thickness of the sanding blade only, and the integral retaining tab may protrude into the pocket. The engagement of the sanding blade by the pocket and the retaining tab may mechanically lock the sanding blade relative to the riser and the base.

The sanding wheel according to the principles of the present invention is configured to couple to a mount and/or an output axis of a tool. For example, the exemplary wheel 10 includes a fastener 60 fixed at in a center portion 62 of base 12. The base 12 may include a through aperture (not shown), and the fastener 60 may be aligned with the through aperture. In some embodiments, e.g., the fastener 60 may be in the form of a threaded nut affixed to the center portion 62 and overlapping the through aperture, so that a complementary threaded bolt or stud may threadingly engage the fastener 60 from either axial direction. Fastener 60 may be configured to attach to a variety of devices which will rotate sanding wheel 10. These devices are not shown but may include a high speed grinding tool which may operate at between 5000 rpm to 15,000 rpm.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A sanding wheel comprising:

a base rotatable about an axis, the base having a front face and at least one riser extending from the front face along the axis, the riser including a face angled at a riser angle which is an oblique angle relative to the front face of the base and a cross member including a front surface extending transverse to the face of the riser, the face of the riser and the cross member defining a an elongate slot therebetween wherein the slot is angled at the riser angle;

a fastening clip including a retaining spring, the fastening clip received on the face of the riser with the retaining spring extending into the slot; and a blade having an abrasive on a first end and an aperture at a second end, the aperture being defined by a shoulder about the aperture, the second end of the blade extending into the slot with the retaining spring of the fastening clip engaging the shoulder of the sanding blade, the slot and the retaining spring configured to mechanically lock the blade to the riser and the base.

2. The sanding wheel of claim 1 further comprising a plurality of risers, each riser having an associated fastening clip and blade.

3. The sanding wheel of claim 2 wherein the angled face of each riser includes a pair of channels separated by a boss and the respective fastening clips each include a pair of legs, the legs being positioned in the channels of the angled faces of the risers, respectively.

4. The sanding wheel of claim 1 wherein the base is made from plastic and the fastening clip is made from metal.

5. The sanding wheel of claim 1 wherein the blade is made from metal and the abrasive includes diamonds.

6. A sanding blade configured for attachment to a sanding wheel, the sanding wheel including a riser having a face angled at a riser angle which is an oblique angle relative to a front face of a base and a cross member, the base being rotatable about an axis and the riser extending from the front face along the axis, the cross member including a front surface extending transverse to the face of the riser, the face of the riser and the cross member defining an elongate slot therebetween, the wheel further including a retaining spring within the slot, the blade comprising:

a sanding section having an abrasive particle affixed thereto; and a retaining shoulder adjacent to an aperture in the sanding blade, the retaining shoulder sized to mate with the retaining spring, the slot and the retaining spring configured to mechanically lock the blade to the riser and the base.

7. A sanding blade as in claim 6 wherein the sanding blade is made from metal and the abrasive particles are brazed onto a front face of the sanding blade.

8. A sanding blade as in claim 7 wherein the abrasive particles are diamonds.

9. A sanding blade as in claim 6 further comprising a back face that is free from abrasive particles.

10. An assembly for coupling a sanding blade to a sanding wheel, comprising:

a base surface rotatable about an axis and having a front face;

a riser component extending from the base surface front face along the axis, the riser component including a flat surface angled at a riser angle which is an oblique angle relative to the front face of the base, a boss member protruding from the angled surface, a cross member overlapping the angled surface between the boss member and the base surface, the cross member including a front surface extending transverse to the flat surface of the riser, and an elongate pocket defined between the angled surface and the cross member;

a clip member disposed against the flat surface and engaged with the boss member, the clip member including a retaining spring extending into the elongate pocket; and a blade component including an abrasive first end and an aperture at a second end opposite the abrasive first end, the second end of the blade component extending into the elongate pocket between the clip member and the flat surface, the retaining spring of the clip member extending into the aperture of the blade component and engaging the blade component at the aperture, the pocket and the retaining spring configured to mechanically lock the blade to the riser and the base.

* * * * *